US009815285B2

(12) United States Patent
Otome et al.

(10) Patent No.: US 9,815,285 B2
(45) Date of Patent: Nov. 14, 2017

(54) LIQUID DISCHARGE HEAD, LIQUID DISCHARGE DEVICE, AND LIQUID DISCHARGE APPARATUS

(71) Applicants: Yukio Otome, Ibaraki (JP); Takahiro Yoshida, Ibaraki (JP); Takayuki Nakai, Kanagawa (JP); Shiomi Andou, Kanagawa (JP); Kanshi Abe, Ibaraki (JP); Kenshiroh Munetomo, Ibaraki (JP); Toshimichi Odaka, Kanagawa (JP)

(72) Inventors: Yukio Otome, Ibaraki (JP); Takahiro Yoshida, Ibaraki (JP); Takayuki Nakai, Kanagawa (JP); Shiomi Andou, Kanagawa (JP); Kanshi Abe, Ibaraki (JP); Kenshiroh Munetomo, Ibaraki (JP); Toshimichi Odaka, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 15/358,486

(22) Filed: Nov. 22, 2016

(65) Prior Publication Data

US 2017/0157924 A1 Jun. 8, 2017

(30) Foreign Application Priority Data

Dec. 3, 2015 (JP) ..... 2015-236445
Sep. 16, 2016 (JP) ..... 2016-181190

(51) Int. Cl.
*B41J 2/04* (2006.01)
*B41J 2/14* (2006.01)

(52) U.S. Cl.
CPC ..... *B41J 2/1433* (2013.01); *B41J 2/14233* (2013.01); *B41J 2/14274* (2013.01); *B41J 2002/14306* (2013.01)

(58) Field of Classification Search
CPC ..... B41J 2/14233; B41J 2/1433; B41J 2002/14306; B41J 2202/19; B41J 2/14314; B41J 2/14274; B41J 2/1609
(Continued)

(56) References Cited

U.S. PATENT DOCUMENTS 7,503,640 B2 * 3/2009 Sugahara ..... B41J 2/145 239/690
2008/0100666 A1 * 5/2008 Kim ..... B41J 2/1404 347/47

(Continued)

FOREIGN PATENT DOCUMENTS

JP 9-239978 9/1997
JP 10-138474 5/1998

*Primary Examiner* — An Do
(74) *Attorney, Agent, or Firm* — Cooper & Dunham LLP

(57) ABSTRACT

A liquid discharge head includes a channel plate. The channel plate includes a fluid restrictor, a channel, a first plate member, and a second plate member. The channel is disposed on at least one of an upstream side and a downstream side of the fluid restrictor in a direction of flow of liquid. The channel has a greater width than a width of the fluid restrictor in a direction perpendicular to the direction of flow of liquid in an in-plane direction. The first plate member has a through hole including at least one broad portion and a narrow portion. The narrow portion is the fluid restrictor. The second plate member includes at least one through hole constituting part of the channel with the broad portion. The through hole is disposed opposite an end of the narrow portion at which the narrow portion is connected to the broad portion.

20 Claims, 15 Drawing Sheets

(58) Field of Classification Search
USPC ..... 347/20, 40, 47, 54, 68, 70
See application file for complete search history.

(56) References Cited

U.S. PATENT DOCUMENTS

| | | | |
|---|---|---|---|
| 2015/0246536 | A1 | 9/2015 | Yoshida |
| 2016/0082728 | A1 | 3/2016 | Kohda et al. |
| 2016/0096369 | A1 | 4/2016 | Shimizu et al. |
| 2016/0185113 | A1 | 6/2016 | Yoshida et al. |

* cited by examiner

LIQUID DISCHARGE HEAD, LIQUID DISCHARGE DEVICE, AND LIQUID DISCHARGE APPARATUS

CROSS-REFERENCE TO RELATED APPLICATIONS

This patent application is based on and claims priority pursuant to 35 U.S.C. §119(a) to Japanese Patent Application Nos. 2015-236445 filed on Dec. 3, 2015 and 2016-181190 filed on Sep. 16, 2016 in the Japan Patent Office, the entire disclosure of each of which is hereby incorporated by reference herein.

BACKGROUND

Technical Field

Aspects of the present disclosure relate to a liquid discharge head, a liquid discharge device, and a liquid discharge apparatus.

Related Art

A liquid discharge head (droplet discharge head) to discharge liquid has, for example, a configuration of supplying liquid from a common liquid chamber or a liquid introduction portion communicated with the common liquid chamber to an individual liquid chamber via a fluid restrictor, to enhance the efficiency in pressurizing liquid in the individual liquid chamber.

For example, in a liquid discharge head, a plurality of plate members may be laminated one on another as a channel plate (channel member) to form narrow fluid restrictors, individual liquid chambers downstream from the fluid restrictors, and broad channels, such as a common liquid chamber or liquid introduction portions upstream from the fluid restrictors, being broader than the fluid restrictors.

SUMMARY

In an aspect of the present disclosure, there is provided a liquid discharge head that includes a channel plate. The channel plate includes a fluid restrictor, a channel, a first plate member, and a second plate member. The channel is disposed on at least one of an upstream side and a downstream side of the fluid restrictor in a direction of flow of liquid. The channel has a greater width than a width of the fluid restrictor in a direction perpendicular to the direction of flow of liquid in an in-plane direction of the channel plate. The first plate member and a second plate member are laminated one on another. The first plate member has a through hole. The through hole includes at least one broad portion and a narrow portion. At least one broad portion has the greater width and constitutes part of the channel. The narrow portion is the fluid restrictor and has a smaller width than the greater width of the at least one broad portion. The narrow portion is connected to the at least one broad portion. The second plate member includes at least one through hole that constitutes part of the channel with the at least one broad portion. The at least one through hole is disposed opposite an end of the narrow portion of the first plate member at which the narrow portion is connected to the at least one broad portion.

In another aspect of the present disclosure, there is provided a liquid discharge head that includes a channel plate. The channel plate includes a fluid restrictor, a channel, a first plate member, and a second plate member. The channel is disposed on at least one of an upstream side and a downstream side of the fluid restrictor in a direction of flow of liquid. The channel has a greater width than a width of the fluid restrictor in a direction perpendicular to the direction of flow of liquid in an in-plane direction of the channel plate. The first plate member and a second plate member are laminated one on another. The first plate member has a groove. The groove includes at least one broad portion and a narrow portion. At least one broad portion has the greater width and constitutes part of the channel. The narrow portion is the fluid restrictor and has a smaller width than the greater width of the at least one broad portion. The narrow portion is connected to the at least one broad portion. The second plate member includes at least one groove that constitutes part of the channel with the at least one broad portion. The at least one groove is disposed opposite an end of the narrow portion of the first plate member at which the narrow portion is connected to the at least one broad portion.

In still another aspect of the present disclosure, there is provided a liquid discharge device that includes the liquid discharge head according to any of the above-described aspects, to discharge the liquid.

In still yet another aspect of the present disclosure, there is provided a liquid discharge apparatus that includes the liquid discharge device.

In still yet another aspect of the present disclosure, there is provided a liquid discharge apparatus that includes the liquid discharge head according to any of the above-described aspects, to discharge the liquid.

BRIEF DESCRIPTION OF THE SEVERAL VIEWS OF THE DRAWINGS

The aforementioned and other aspects, features, and advantages of the present disclosure would be better understood by reference to the following detailed description when considered in connection with the accompanying drawings, wherein.

Figure 1:
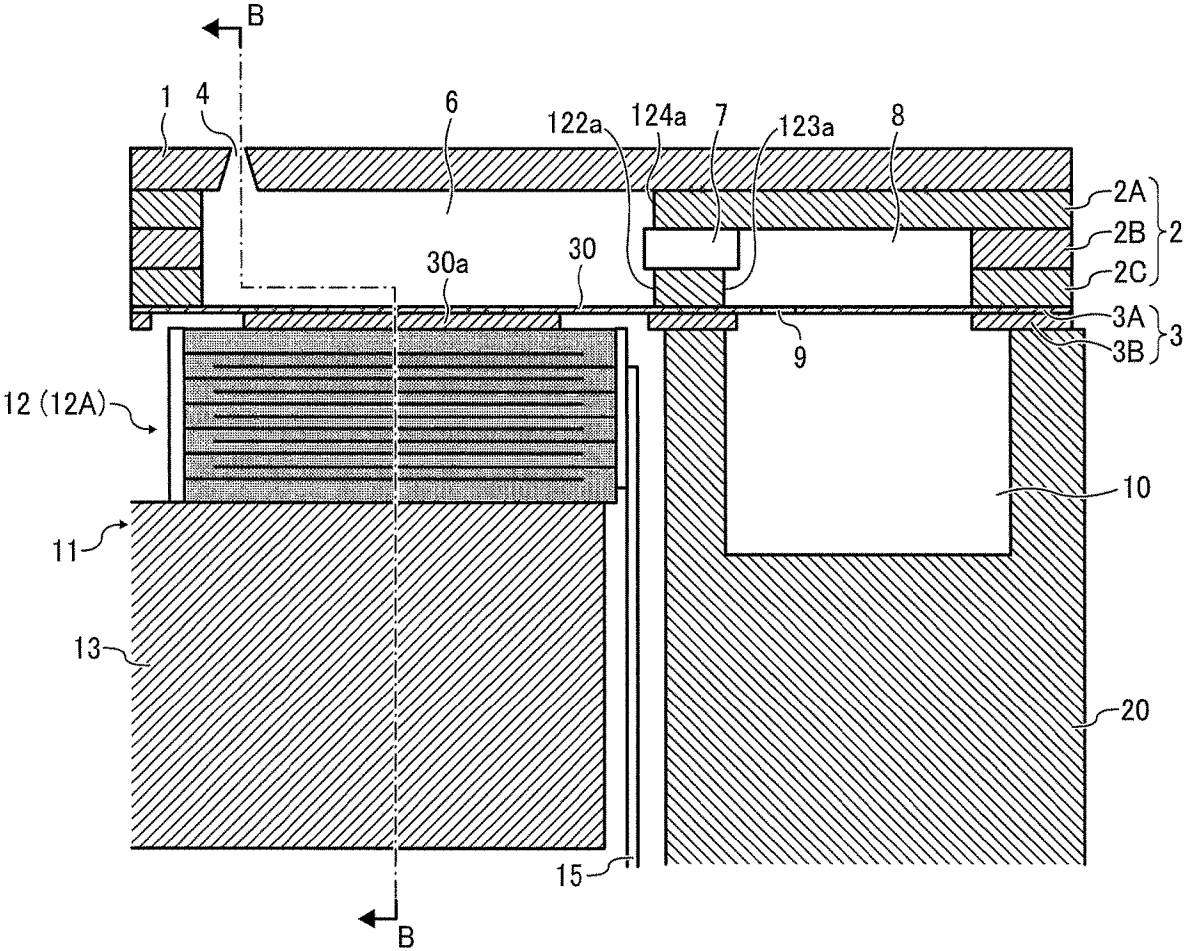
FIG. 1 is a cross-sectional view of a liquid discharge head according to a first embodiment of the present disclosure, cut along line A-A of FIG. 3 in a direction (a longitudinal direction of an individual liquid chamber) perpendicular to a nozzle array direction.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

Although the embodiments are described with technical limitations with reference to the attached drawings, such description is not intended to limit the scope of the disclosure and all of the components or elements described in the embodiments of this disclosure are not necessarily indispensable.

Figure 2:
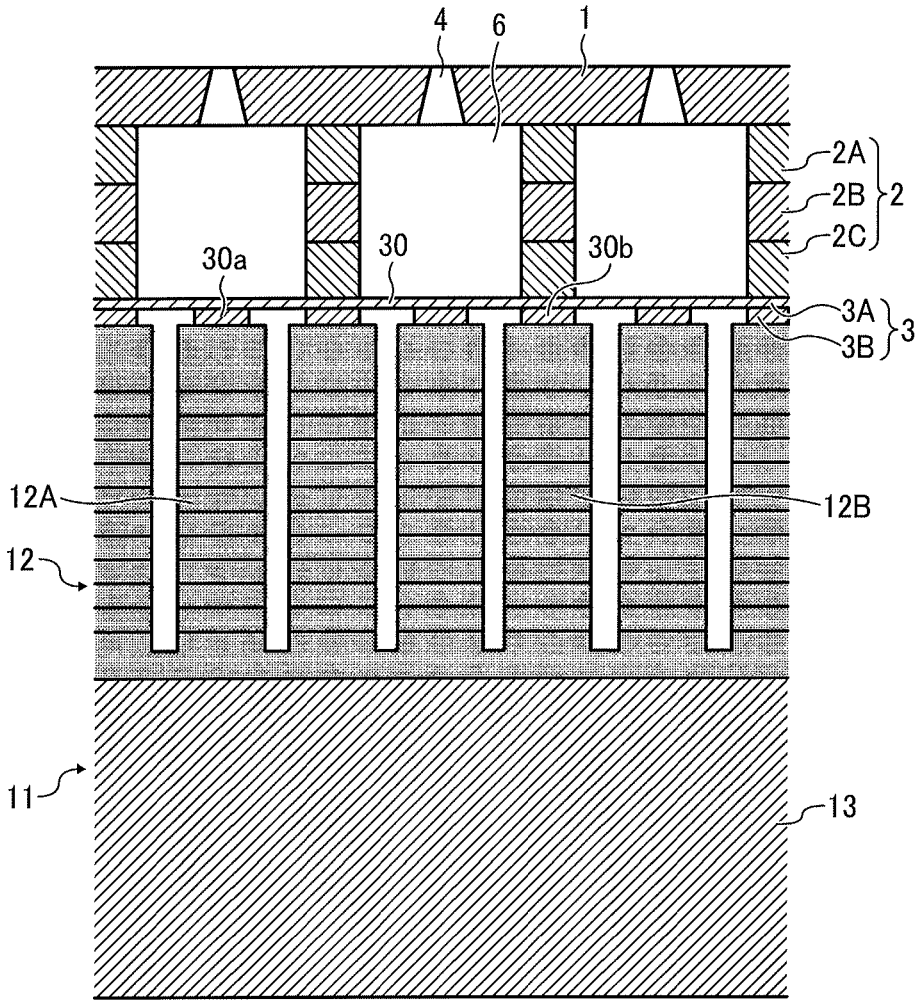
FIG. 2 is a cross-sectional view of the liquid discharge head cut along line B-B of FIG. 1 in the nozzle array direction (a short direction of the individual liquid chamber)
Figure 3:
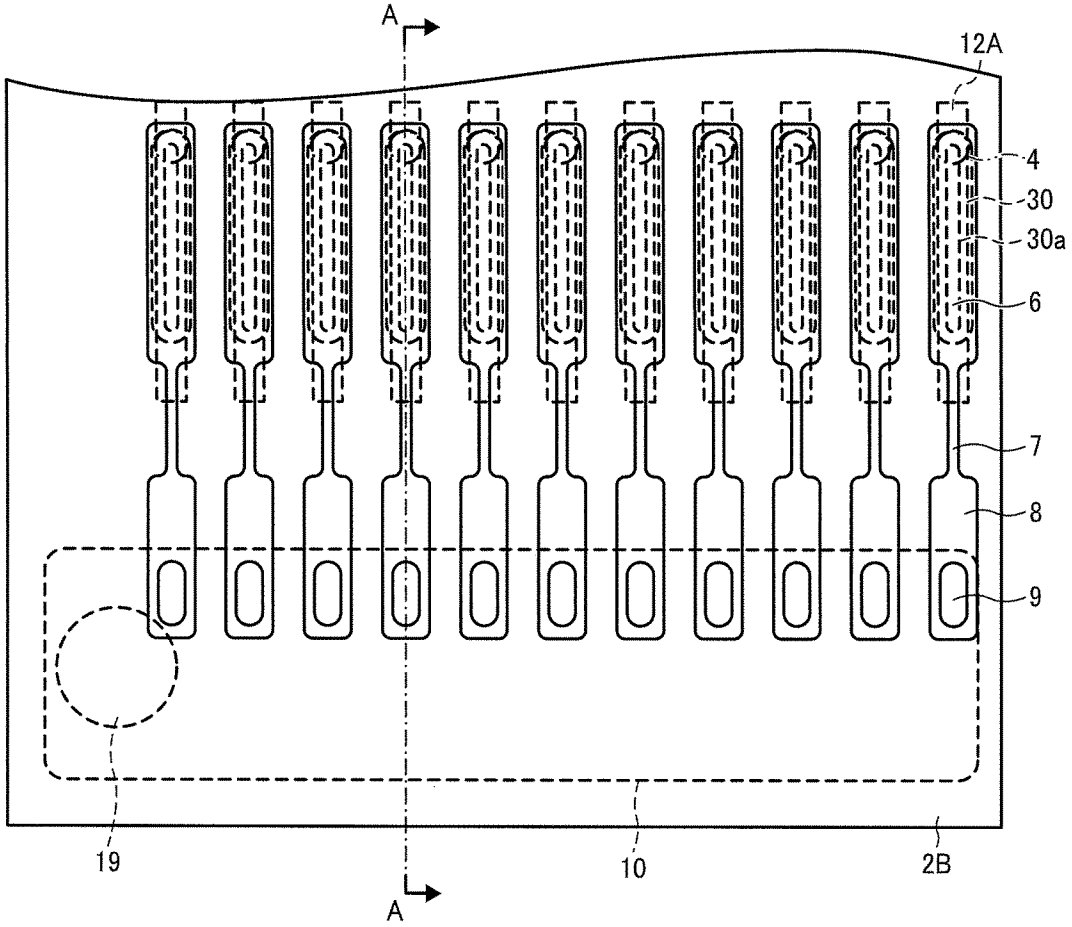
FIG. 3 is a plan view of a portion of the liquid discharge apparatus of FIG. 1 including a liquid discharge device.

Hereinafter, embodiments of the present disclosure are described with reference to the attached drawings. A liquid discharge head according to a first embodiment of the present disclosure is described with reference to FIGS. 1 to 3. FIG. 1 is a cross-sectional view of the liquid discharge head according to the first embodiment, cut along line A-A of FIG. 3 in a direction (longitudinal direction of an individual liquid chamber) perpendicular to a nozzle array direction in which nozzles are arrayed in row. FIG. 2 is a cross-sectional view of the liquid discharge head cut along line B-B in the nozzle array direction (transverse direction of the individual liquid chamber). FIG. 3 is a plan view of the liquid discharge head of FIG. 1 seen from a plate member as a top face.

A liquid discharge head 404 according to the first embodiment of the present disclosure includes a nozzle plate 1, a channel plate 2, and a diaphragm member 3 as a wall member that are laminated one on another and bonded to each other. The liquid discharge head 404 includes piezoelectric actuators 11 to displace the diaphragm member 3 and a frame member 20 as a common-liquid-chamber substrate.

The channel plate 2 constitutes individual liquid chambers 6 communicated with a plurality of nozzles 4 to discharge liquid, fluid restrictors 7, and liquid introduction portions 8.

Liquid is introduced from the common liquid chamber 10 of the frame member 20 through openings 9 of the diaphragm member 3 and supplied from the liquid introduction portions 8 to the individual liquid chambers 6 via the fluid restrictors 7. Note that filters may be disposed at the openings 9.

In the present embodiment, the nozzle plate 1 includes the nozzles 4 being nozzle orifices formed by pressing a stainless steel as a nozzle substrate. A liquid repellent film is disposed on a discharge side of the nozzle plate 1.

The channel plate 2 includes a plurality of (in the present embodiment, three) plate members 2A, 2B, and 2C laminated one on another in a thickness direction of the channel plate 2.

The diaphragm member 3 constitutes a wall face of each of the individual liquid chambers 6 of the channel plate 2 and has a two layer structure of a first layer 3A and a second layer 3B. Note that the number of layers of the diaphragm member 3 is not limited to two and may be one, or three or more. The first layer 3A facing the channel plate 2 includes a deformable vibration portions (diaphragms) 30 at areas corresponding to the individual liquid chambers 6.

The diaphragm member 3 is formed of a metal plate of nickel (Ni) and produced by electroforming. However, the material of the diaphragm member 3 is not limited to Ni. In some embodiments, other metal member or a member including a plurality of layers of resin and metal.

The piezoelectric actuators 11 including electromechanical transducer elements as driving devices (actuator devices or pressure generators) to deform the vibration portions 30 of the diaphragm member 3 are disposed at a first side of the diaphragm member 3 opposite a second side facing the individual liquid chambers 6.

The piezoelectric actuator 11 includes multi-layer piezoelectric members 12 bonded on a base 13 with adhesive. The piezoelectric members 12 are groove-processed by half cut dicing to form a desired number of pillar-shaped piezoelectric elements (piezoelectric pillars) 12A and pillar-shaped piezoelectric elements (piezoelectric pillars) 12B that are arranged in certain intervals to have a comb shape.

The piezoelectric elements 12A and the piezoelectric elements 12B of the piezoelectric member 12 are the same. The piezoelectric elements 12A are driven by application of a drive waveform. The piezoelectric elements 12B are used as simple pillars and are not applied with a drive waveform.

The piezoelectric elements 12A are bonded to projections 30*a* being island-shaped thick portions in the vibration portions 30 of the diaphragm member 3. The piezoelectric elements 12B are bonded to projections 30*b* being thick portions of the diaphragm member 3.

The piezoelectric member 12 includes piezoelectric layers and internal electrodes alternately laminated one on another. The internal electrodes are led out to end faces to form external electrodes. A flexible printed circuit (FPC) 15 as a flexible wiring member is connected to the external electrodes of the piezoelectric elements 12A to apply driving signals to the piezoelectric elements 12A.

The frame member 20 is formed by injection molding on, for example, epoxy resin or thermoplastic resin, such as polyphenylene sulfide, to include the common liquid chamber 10 to supply liquid from a head tank or a liquid cartridge through a supply port 19.

In the liquid discharge head 404, for example, when a voltage applied to the piezoelectric element 12A is lowered from a reference potential, the piezoelectric element 12A contracts. As a result, the vibration portion 30 of the diaphragm member 3 is drawn outward to increase the volume of the individual liquid chamber 6, thus causing liquid to flow into the individual liquid chamber 6.

When the voltage applied to the piezoelectric element 12A is raised, the piezoelectric element 12A expands in a direction of lamination. The vibration portion 30 of the diaphragm member 3 deforms in a direction toward the nozzle 4 and contracts the volume of the individual liquid chamber 6. Thus, liquid in the individual liquid chamber 6 is pressurized and discharged (jetted) from the nozzle 4.

When the voltage applied to the piezoelectric element 12A is returned to the reference potential, the vibration portion 30 of the diaphragm member 3 is returned to the initial position. Accordingly, the individual liquid chamber 6 expands to generate a negative pressure, thus replenishing liquid from the common liquid chamber 10 into the individual liquid chamber 6. After the vibration of a meniscus surface of the nozzle 4 decays to a stable state, the liquid discharge head 404 shifts to an operation for the next droplet discharge.

Note that the driving method of the liquid discharge head is not limited to the above-described example (pull-push discharge). For example, pull discharge or push discharge may be performed in response to the way to apply the drive waveform.

Figure 4:
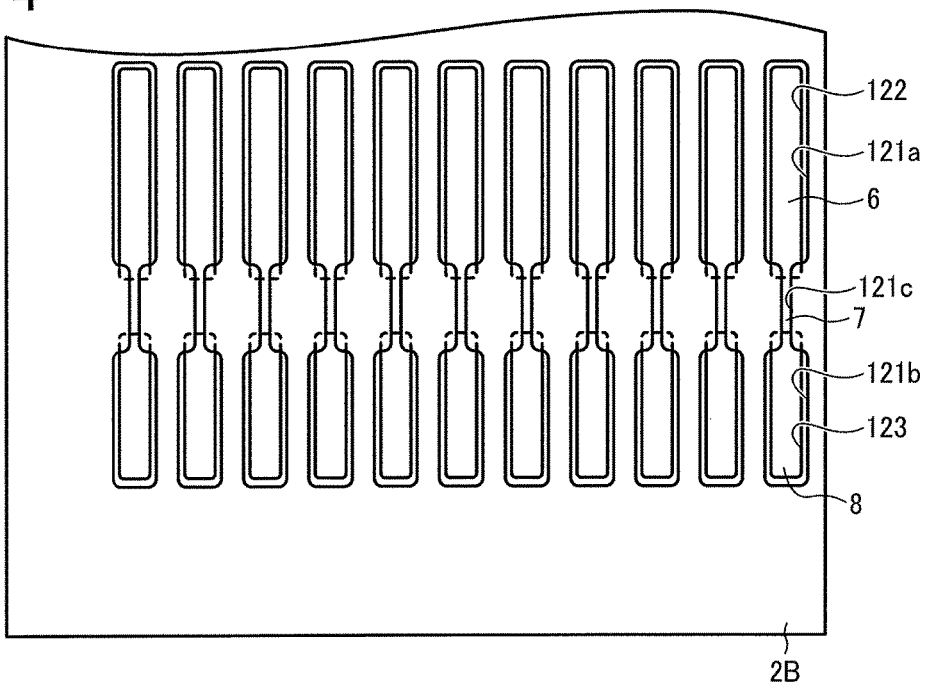
FIG. 4 is a plan view of a first plate member and a second plate member constituting a channel plate in a laminated state, seen from a side at which the first plate member is disposed.
Figure 5:
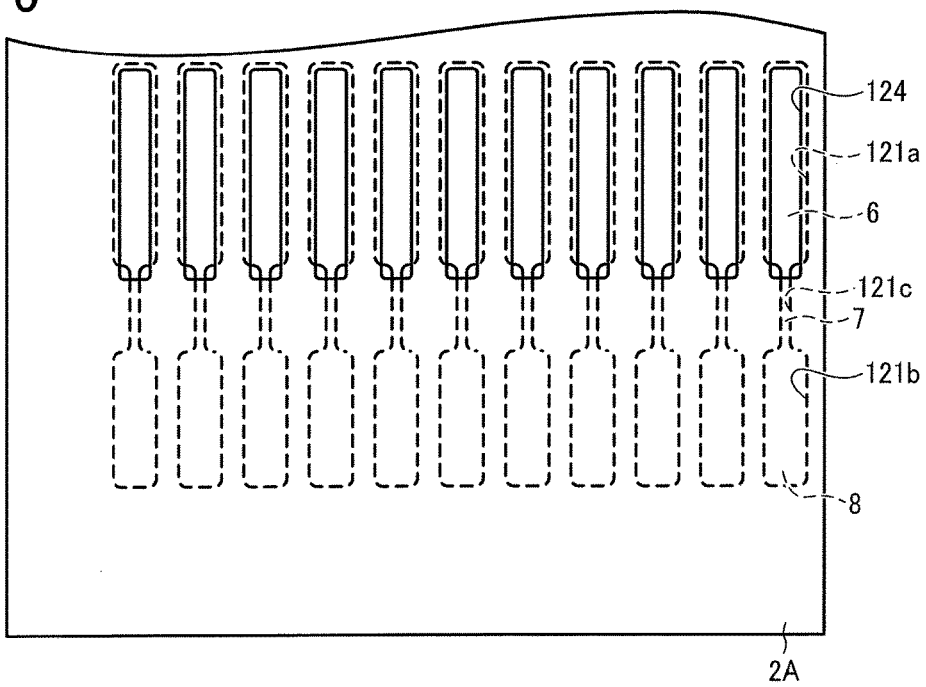
FIG. 5 is a plan view of the first plate member and another second plate member constituting the channel plate in a laminated state, seen from a side at which the first plate member (2B) is disposed.
Figure 6:
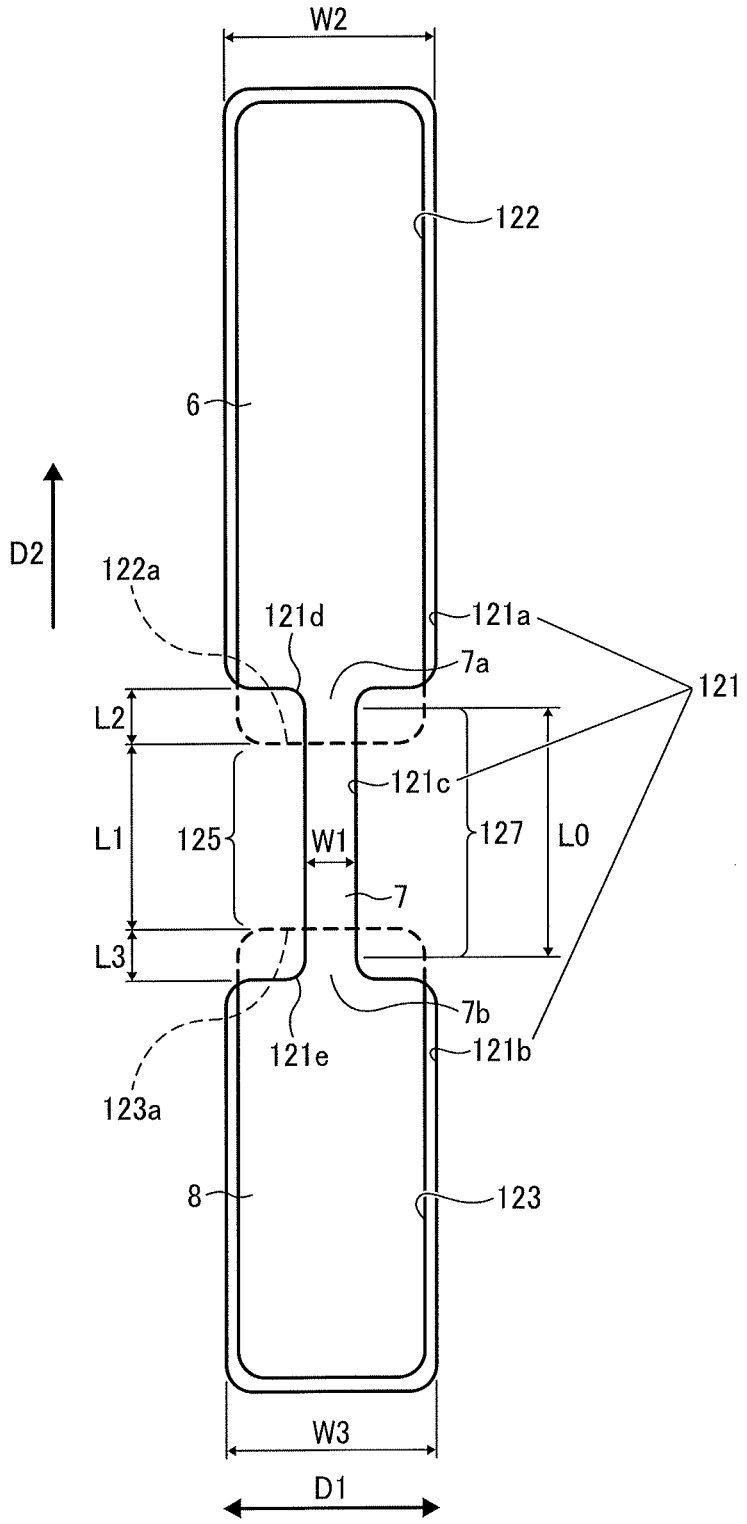
FIG. 6 is an enlarged plan view of a channel portion including the fluid restrictor of the liquid discharge head.

Next, the channel plate in the present embodiment is described with reference to FIGS. 4 to 6. FIG. 4 is a plan view of the plate member 2B and the plate member 2C constituting the channel plate in a laminated state, seen from a side at which the plate member 2B is disposed. FIG. 5 is a plan view of the plate member 2A and the plate member 2B constituting the channel plate in a laminated state, seen from a side at which the plate member 2A is disposed. FIG. 6 is an enlarged plan view of a channel portion including the fluid restrictor.

The channel plate 2 includes the fluid restrictors 7, the individual liquid chambers 6, and the liquid introduction portions 8. The individual liquid chamber 6 and the liquid introduction portion 8, respectively, are disposed downstream and upstream from the fluid restrictor 7. Each of the individual liquid chamber 6 and the liquid introduction portion 8 is a channel having a greater width in a direction D1 perpendicular to a direction of flow of liquid (liquid flow direction) D2 in an in-plane direction than the fluid restrictor 7.

As illustrated in FIG. 6, a relation of W1<W2 and a relation of W1<W3 are satisfied, where W1 represents the width of the fluid restrictor 7 in the plate member 2B, W2 represents the width of the individual liquid chamber 6, and W3 represents the width of the liquid introduction portion 8 (W2 may be equal to W3). However, as described below, the plate member 2C constituting part of the individual liquid chambers 6 and the liquid introduction portions 8 and the plate member 2A constituting part of the individual liquid chambers 6 and the liquid introduction portions 8 have smaller widths at portions corresponding to the individual liquid chambers 6 and the liquid introduction portions 8 than the width W2 and the width W3, respectively.

As described above, the channel plate 2 has a configuration of the plate member 2A, the plate member 2B, and the plate member 2C laminated one on another from a side at which the nozzle plate 1 is disposed. In the present embodiment, the plate member 2B is "a first plate member" and each of the plate member 2A and the plate member 2C is "a second plate member".

The plate member 2B being the first plate member has through holes 121, each of which includes a broad portion 121*a* of a greater width W2, a broad portion 121*b* of a greater width W3, and a narrow portion 121*c* of a smaller width W1. The narrow portion 121*c* is connected to the broad portion 121*a* and the broad portion 121*b*.

The broad portion 121*a* of the through hole 121 of the plate member 2B is part of the individual liquid chamber 6 being a channel downstream from the fluid restrictor 7 in the liquid flow direction D2. The broad portion 121*b* of the through hole 121 is part of the liquid introduction portion 8 being a channel upstream from the fluid restrictor 7.

The narrow portion 121*c* of the through hole 121 of the plate member 2B is connected to the broad portion 121*a* and the broad portion 121*b* and forms the fluid restrictor 7. The narrow portion 121*c* of the plate member 2B includes a straight region (constant-width region) 127 having the constant width W1 and a length L0.

The plate member 2C being the second plate member includes through holes 122 and through holes 123.

The through hole 122 of the plate member 2C constitutes part of the individual liquid chamber 6 being a channel, together the broad portion 121*a* of the through hole 121 of the plate member 2B. The through holes 123 constitutes part of the liquid introduction portion 8 being a channel, together the broad portion 121*b* of the through hole 121 of the plate member 2B. A partition wall portion 125 is disposed between the through hole 122 and the through hole 123 and has a length L1 (L1<L0) in the liquid flow direction D2 in the fluid restrictor 7.

The plate member 2A being the second plate member includes through holes 124, each of which constitutes part of the individual liquid chamber 6 being a channel, together the broad portion 121*a* of the through hole 121 of the plate member 2B.

In FIGS. 4 to 6, each of the width of the through hole 122 of the plate member 2C, the width of the through hole 123 of the plate member 2C, and the width of the through hole 124 of the plate member 2A is smaller than each of the width W2 of the broad portion 121*a* of the through hole 121 of the plate member 2B and the width W3 of the broad portion 121*b* of the through hole 121 of the plate member 2B. However, in some embodiments, each of the width of the through hole 122 of the plate member 2C, the width of the through hole 123 of the plate member 2C, and the width of the through hole 124 of the plate member 2A may be the same as or greater than the width W2 and the width W3.

End portions of the narrow portion 121*c* of the through hole 121 of the plate member 2B that are connected to the broad portion 121*a* and the broad portion 121*b* are an outlet 7*a* and an inlet 7*b*, respectively, of the fluid restrictor 7. Wall faces of corners 121*d* and 121*e* of the end portions have curved shapes (R-shapes) in the in-plane direction. In some embodiments, the corner 121*d* and the corner 121*e* of the end portions may have inclined shapes instead of curved shapes.

Here, the through hole 122 of the plate member 2C is disposed opposite the corner 121*d* of the outlet 7*a*, which is the end portion of the narrow portion 121*c* of the through hole 121 of the plate member 2B that is connected to the broad portion 121*a*. The through hole 123 of the plate member 2C is disposed opposite the corner 121*e* of the inlet 7*b* of the fluid restrictor 7, which is the end portion of the narrow portion 121*c* of the through hole 121 of the plate member 2B that is connected to the broad portion 121*b*.

An upstream end 122*a* of the through hole 122 of the plate member 2C in the liquid flow direction D2 is disposed opposite the constant-width region 127 in the narrow portion 121*c* of the through hole 121 of the plate member 2B. Similarly, a downstream end 123*a* of the through hole 123 of the plate member 2C in the liquid flow direction D2 is disposed opposite the constant-width region 127 in the narrow portion 121*c* of the through hole 121 of the plate member 2B.

Accordingly, in such a case, the partition wall portion 125 between the through hole 122 and the through hole 123 of the plate member 2C is entirely disposed opposite the constant-width region 127 in the narrow portion 121*c* of the through hole 121 of the plate member 2B.

An upstream end 124*a* of the through hole 124 of the plate member 2A is disposed at the same position as or downstream from the upstream end 122*a* of the through hole 122 of the plate member 2C.

With such a configuration, the fluid resistance of the fluid restrictor 7 can be defined by the length L1 of the partition wall portion 125 between the through hole 122 and the through hole 123 of the plate member 2C, thus reducing a variation in the fluid resistance.

In such a case, since the length of the narrow portion 121*c* being the fluid restrictor 7 is defined by the upstream end 122*a* of the through hole 122 constituting the individual liquid chamber 6, the variation in the fluid resistance can be reduced even if the length and the end shape of the narrow portion 121*c* varies.

Next, the present embodiment is further described below.

The plate members 2A to 2C constituting the channel plate 2 is made of stainless steel (SUS) material and the through holes 121 to 124 are formed by etching the plate members 2A to 2C.

When the through holes 121 to 124 are formed by etching, corners are likely to corrode. Hence, in the present embodiment, the corner 121*d* and the corner 121*e* each having a curved shape (R-shape) of a radius R of 5 to 100 μm are disposed at the outlet 7*a* and the inlet 7*b*, respectively, of the fluid restrictor 7.

As described above, the curved shape of each of the inlet 7*b* and the outlet 7*a* of the fluid restrictor 7 enhances the uniformity of the flow speed of liquid near the inlet and the outlet of the fluid restrictor 7. Accordingly, liquid is less likely to stay, thus reducing retention of bubbles and allowing stable discharge.

The flatness of the plate member formed by etching is higher than the flatness of the plate member formed by pressing. Accordingly, when a channel is formed by laminating a plurality of plate members, the accuracy of overlaying the plurality of plate members and the accuracy of the dimensions of the channel can be enhanced, thus reducing variations in the discharge speed and amount.

Regarding the positional relationship between the narrow portion 121*c* of the through hole 121 of the plate member 2B and each of the through hole 122 and the through hole 123 of the plate member 2C, as illustrated in FIG. 6, the upstream end 122*a* of the through hole 122 and the downstream end 123*a* of the through hole 123 are disposed at positions not opposed to the corner 121*d* and the corner 121*e* of the through hole 121 of the plate member 2B.

In such a case, as a length L2 and a length L3 illustrated in FIG. 6 at which the narrow portion 121*c* overlaps the through hole 122 and the through hole 123, respectively, increase, the size of the liquid discharge head would increase. Therefore, in the present embodiment, each of the length L2 and the length L3 are set to be equal to or smaller than 200 μm.

Here, the relation between the fluid resistance R and the length L1 is expressed by the following formula (L1 is represented by/in the following formula). The viscosity of liquid, the thickness of the channel plate, and the target fluid resistance value are set to determined the length of the fluid restrictor.

$$R = Cj\mu = \frac{3l\mu}{4ab^3}\frac{1}{1-\frac{192b}{\pi^5 a}\sum_{n=1,3,}^{\infty}\frac{1}{n^5}\tanh\left(\frac{n\pi a}{2b}\right)} \qquad \text{Formula 1}$$

In Formula 1, R represents a fluid resistance [Pa·s/m$^3$], Cj represents a shape resistance (a normalized fluid resistance of liquid having a viscosity of 1), μ represents a viscosity of liquid [Pa·s], a represents a length [m] obtained by dividing the width of the narrow portion 121*c* (the fluid restrictor 7) of the plate member 2B by two, b represents a length [m] obtained by dividing the thickness of the plate member 2B of the plate member 2B (the thickness of the fluid restrictor 7) by two, and l represents a length [m] of a region of the narrow portion 121*c* of the plate member 2B that is not opposite the through hole 122 and the through hole 123 of the plate member 2C, that is, a length of the fluid restrictor.

Accordingly, the length l can be obtained by assigning R, a, b, and μ into the above-described formula. For example, when the viscosity of liquid to be used is in a range of from 0.004 to 0.008 Pa·s, the thickness of each of the plate member 2A, the plate member 2B, and the plate member 2C is in a range of from 30 to 50 μm, and the width of the narrow portion 121*c* being the fluid restrictor 7 of the plate member 2B is in a range of from 30 to 100 μm, the length L1 of a region of the narrow portion 121*c* of the plate member 2B that is not opposite the through hole 122 and the through hole 123 of the plate member 2C, that is, the length L1 of the partition wall portion 125 is set to be in a range of from 30 to 9000 μm so that the fluid resistance determined by the following formula is in a range from 5 to $50\times10^{12}$ [Pa·s/m$^3$].

As found from FIG. 6, the length L2 and the length L3 can be obtained by subtracting the length L1 from the entire length of the fluid restrictor 7.

As the ratio of the cross-sectional area of the constant-width region 127 to the cross-sectional area of the outlet 7*a* and the inlet 7*b* of the fluid restrictor 7 (the cross-sectional area of a cross section perpendicular to the flow of liquid) is smaller, the fluid resistance R more depends on the cross-sectional area and the length of the constant-width region 127 of the fluid restrictor 7.

In the present embodiment, the through hole 122 and the through hole 123 of the plate member 2C are disposed opposite the corner 121*d* and the corner 121*e* of the outlet 7*a* and the inlet 7*b* of the fluid restrictor 7 of the plate member 2B. Accordingly, the ratio of the cross-sectional area of the constant-width region 127 of the fluid restrictor 7 to the cross-sectional area of an area near each of the outlet 7*a* and the inlet 7*b* of the fluid restrictor 7 is relatively small.

With such a configuration, the fluid resistance depends on the cross-sectional area and the length of the constant-width region 127 of the fluid restrictor 7 and is less likely to be affected by variations of the R shape of the corner 121*d* and the corner 121*e* of the outlet 7*a* and the inlet 7*b* of the fluid restrictor 7

The cross-sectional area and the length of the constant-width region 127 of the fluid restrictor 7 have higher dimensional accuracy, thus allowing a reduction in variations of fluid resistance and discharge properties.

In the present embodiment, the width of each of the through hole 122 and the through hole 123 of the plate member 2C is greater than the width of the narrow portion 121*c* of the plate member 2B.

In such a case, the ratio of the cross-sectional area of the constant-width region 127 of the fluid restrictor 7 to the cross-sectional area of the outlet 7*a* and the inlet 7*b* of the fluid restrictor 7 is relatively small, the fluid resistance more depends on the cross-sectional area of the constant-width region 127 of the fluid restrictor 7.

With such a configuration, the fluid resistance is less likely to be affected by variations of the R shape of the corner 121*d* and the corner 121*e* of the outlet 7*a* and the inlet 7*b* of the fluid restrictor 7, thus more reducing the variation in the fluid resistance.

Figure 7:
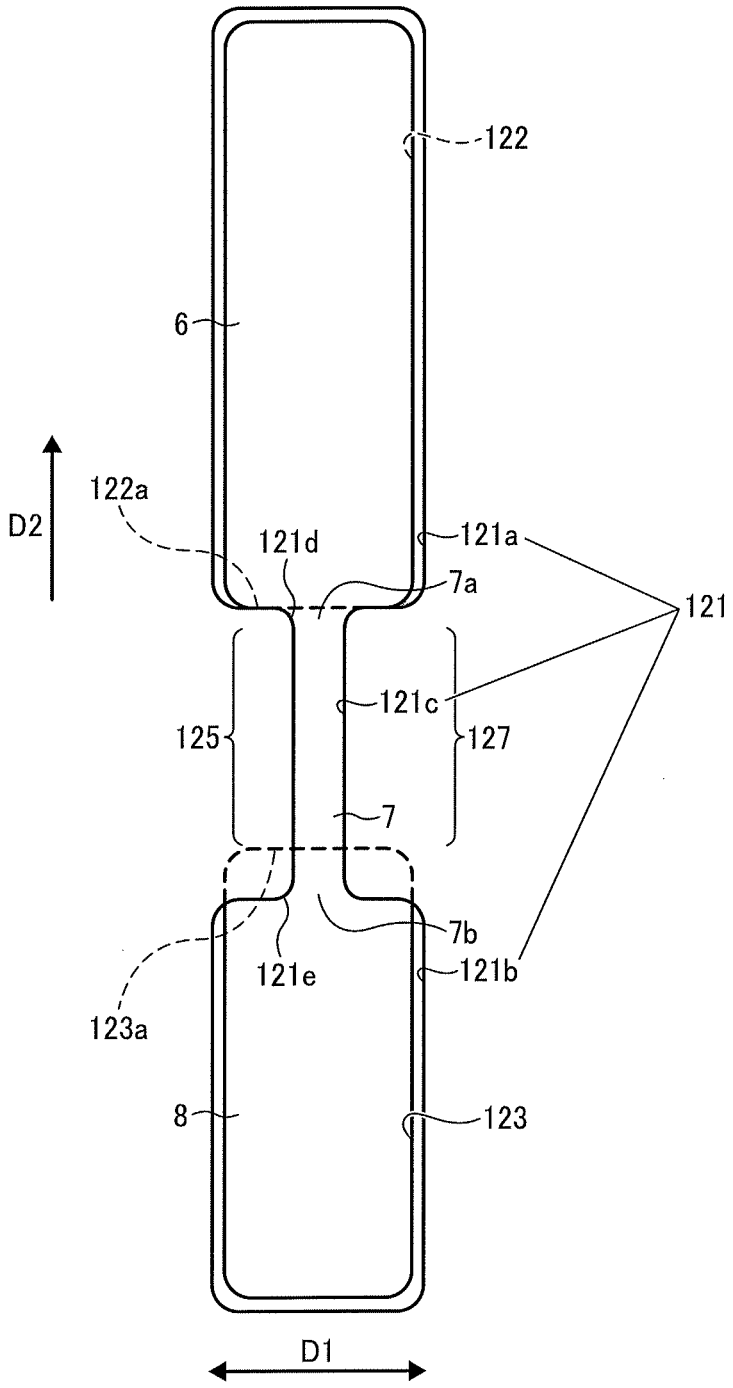
FIG. 7 is a plan view of a channel portion including the fluid restrictor in the liquid discharge head according to a second embodiment of the present disclosure.
Figure 8:
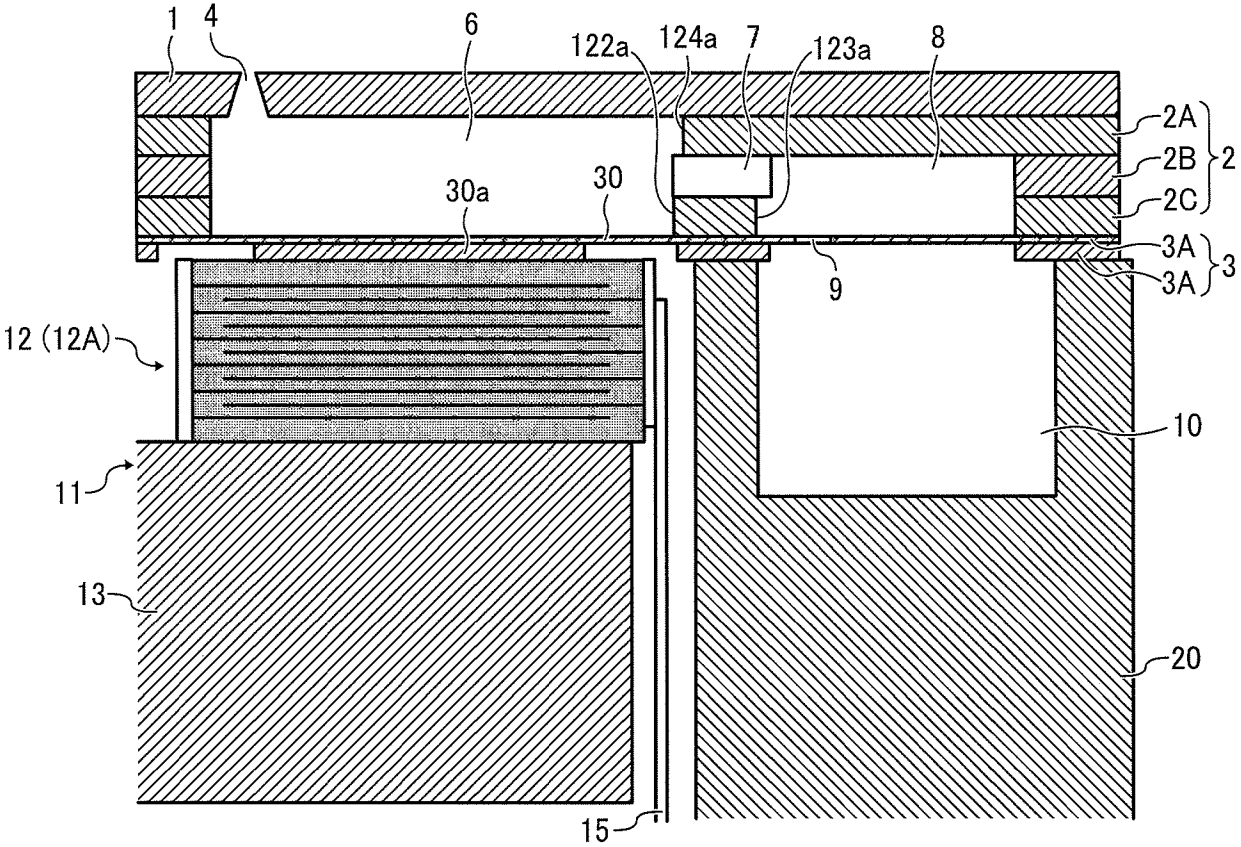
FIG. 8 is a cross-sectional view of the channel portion of the liquid discharge head of FIG. 7 in the direction (the longitudinal direction of the individual liquid chamber) perpendicular to the nozzle array direction.

Next, the liquid discharge head according to a second embodiment of the present disclosure is described with reference to FIGS. 7 and 8. FIG. 7 is a plan view of a channel portion including the fluid restrictor in the liquid discharge head according to the second embodiment. FIG. 8 is a cross-sectional view of the channel portion of the liquid discharge head of FIG. 7 in the direction (the longitudinal direction of the individual liquid chamber) perpendicular to the nozzle array direction.

In the present embodiment, only the downstream end 123*a* of one (in the present embodiment, the through hole 123) of the through hole 122 and the through hole 123 of the plate member 2C is disposed opposite the constant-width region 127 of the narrow portion 121*c*.

In such a configuration, the fluid resistance has a greater variation than in the above-described configuration. However, such a configuration can more reduce the variation in the fluid resistance than in the configuration in which none of the upstream end 122*a* of the through hole 122 and the downstream end 123*a* of the through hole 123 of the plate member 2C are disposed opposite the constant-width region 127 of the narrow portion 121*c*.

In the present embodiment, both the upstream end 124*a* of the through hole 124 of the plate member 2A and the upstream end 122*a* of the through hole 122 of the plate member 2C (that is, one end at the side at which the individual liquid chamber 6 is disposed) are not disposed opposite the constant-width region 127 of the narrow portion 121*c*. Unlike the first embodiment, the corner 121*d* does not project beyond the wall face of the individual liquid chamber 6, thus reducing reflection of vibration of liquid in the individual liquid chamber 6 side.

Figure 9:
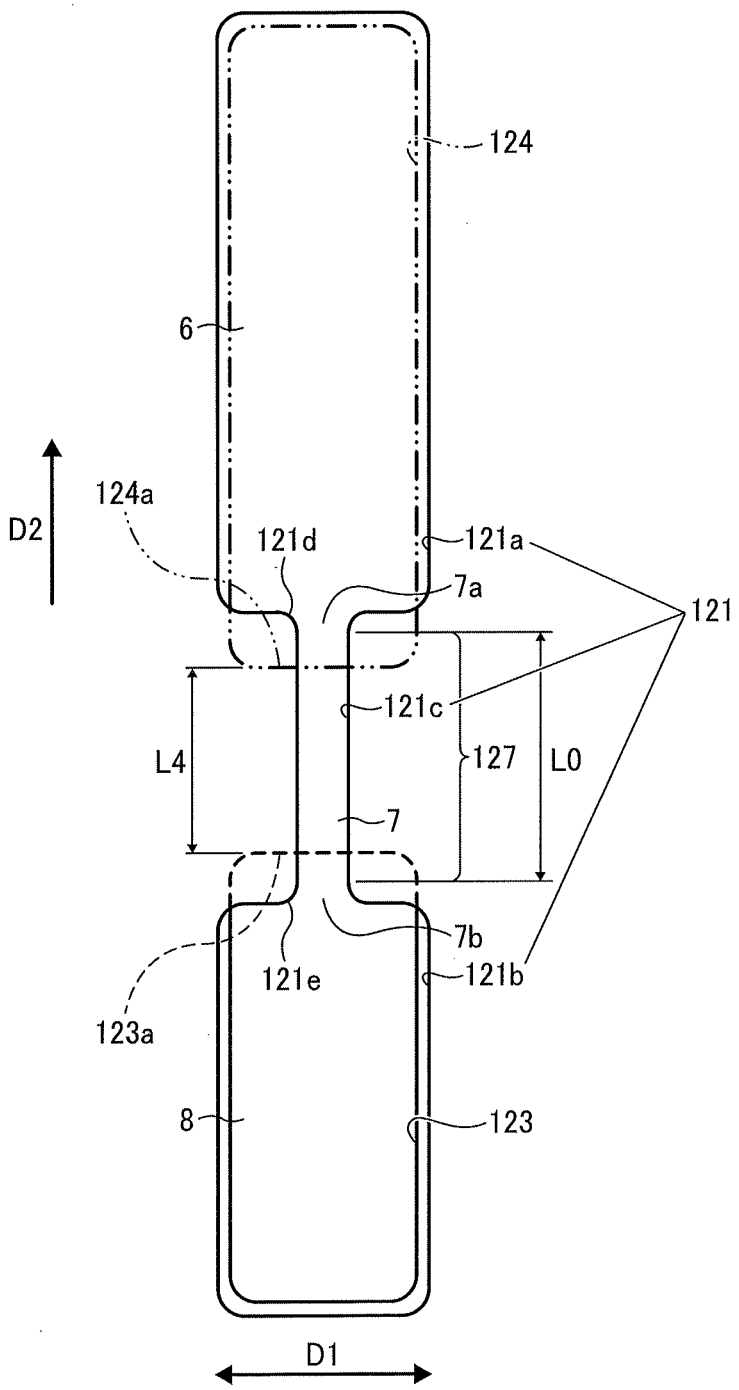
FIG. 9 is a plan view of a channel portion including the fluid restrictor in the liquid discharge head according to a third embodiment of the present disclosure.
Figure 10:
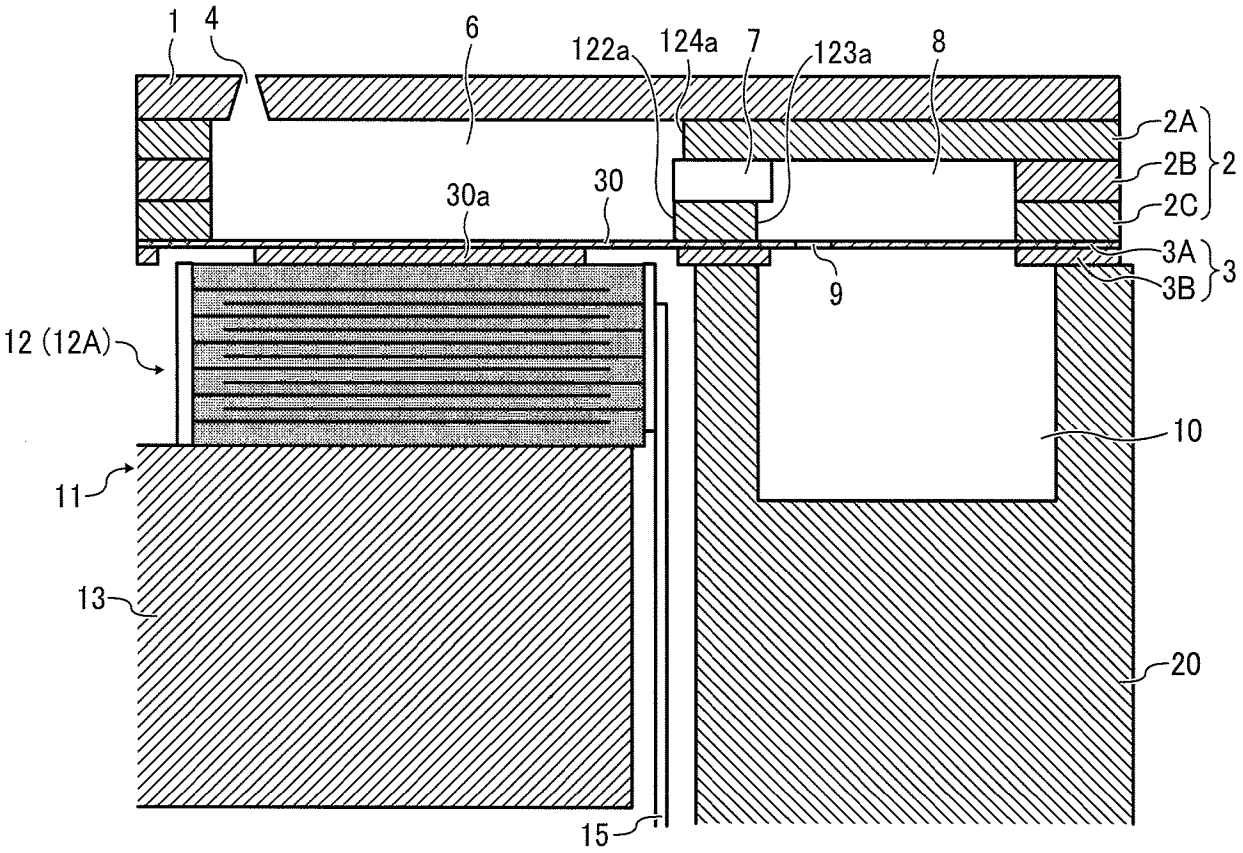
FIG. 10 is a cross-sectional view of the channel portion of the liquid discharge head of FIG. 9 in the direction (the longitudinal direction of the individual liquid chamber) perpendicular to the nozzle array direction.

Next, the liquid discharge head according to a third embodiment of the present disclosure is described with reference to FIGS. 9 and 10. FIG. 9 is a plan view of a channel portion including the fluid restrictor in the liquid discharge head according to the third embodiment. FIG. 10 is a cross-sectional view of the channel portion of the liquid discharge head of FIG. 9 in the direction (the longitudinal direction of the individual liquid chamber) perpendicular to the nozzle array direction.

In the present embodiment, the upstream end 124*a* of the through hole 124 of the plate member 2A is disposed opposite the constant-width region 127 of the narrow portion 121*c*. The downstream end 123*a* of the through hole 123 of the plate member 2C is disposed opposite the constant-width region 127 of the narrow portion 121*c*. As illustrated in FIG. 9, the length L0 of the constant-width region 127 of the narrow portion 121*c* in the liquid flow direction D2 is greater than the length L4 between the upstream end 124*a* of the through hole 124 of the plate member 2A and the downstream end 123*a* of the through hole 123 of the plate member 2C.

In such a configuration, similarly with the above-described first embodiment, the fluid resistance can be defined by the interior of the constant-width region 127 of the fluid restrictor 7 (the narrow portion 121*c*), thus reducing the variation in the fluid resistance.

In the present embodiment, the upstream end 122*a* of the through hole 122 of the plate member 2C is not disposed opposite the constant-width region 127 of the narrow portion 121*c*. Accordingly, the upstream end 122*a*, in which bubbles are likely to stay, is disposed closer to the nozzle 4 than in the above-described first embodiment. Such a configuration can obtain the above-described operation effect and enhance the purging performance of bubbles in head cleaning.

In the present embodiment, the upstream end 122*a* is disposed away from the fluid restrictor 7. Accordingly, a stagnant point is disposed away from the vicinity of the fluid restrictor 7, thus reducing disturbance of the flow of liquid near the fluid restrictor 7.

Figure 11:
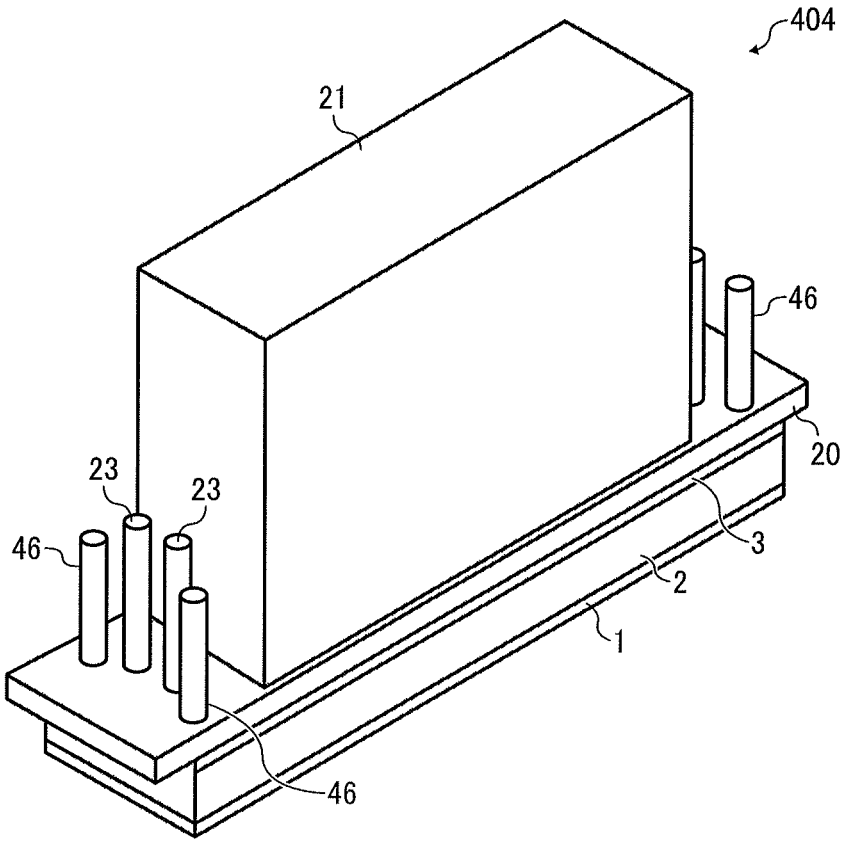
FIG. 11 is an outer perspective view of the liquid discharge head according to a fourth embodiment of the present disclosure.
Figure 12:
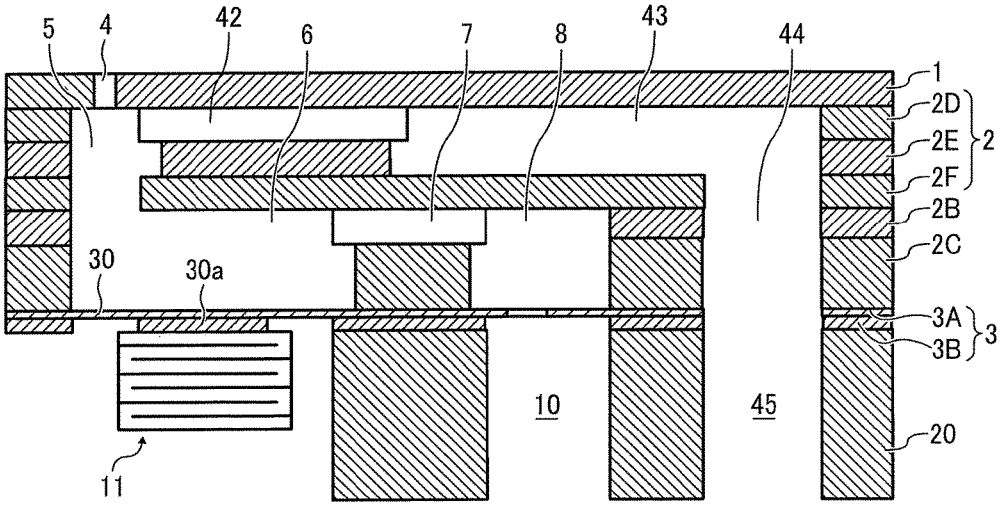
FIG. 12 is a cross-sectional view of the liquid discharge head illustrated in FIG. 11, cut along the longitudinal direction of the individual liquid chamber.
Figure 13:
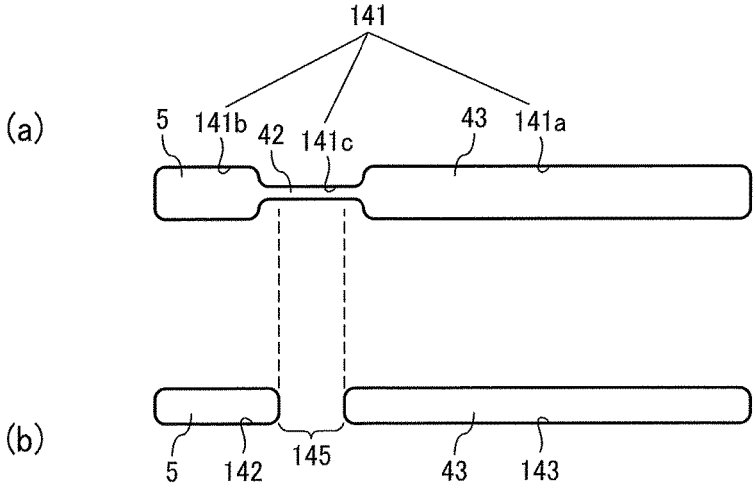
FIG. 13 is a plan view of a circulation channel portion of the liquid discharge head illustrated in FIG. 11.

Next, the liquid discharge head according to a fourth embodiment of the present disclosure is described with reference to FIGS. 11 to 13. FIG. 11 is an outer perspective view of the liquid discharge head according to the fourth embodiment. FIG. 12 is a cross-sectional view of the liquid discharge head illustrated in FIG. 11, cut along the longitudinal direction of the individual liquid chamber. FIG. 13 is a plan view of a circulation channel portion of the liquid discharge head illustrated in FIG. 11. Note that the same reference codes are allocated to portions corresponding to the portions described in the first embodiment, and descriptions of the portions are omitted or simplified below.

The liquid discharge head 404 according to the fourth embodiment of the present disclosure includes the nozzle plate 1, the channel plate 2, and the diaphragm member 3 as a wall member that are laminated one on another and bonded to each other. The liquid discharge head 404 includes the piezoelectric actuators 11 to displace the diaphragm member 3, the frame member 20 as a common-liquid-chamber substrate, and the cover 21.

As illustrated in FIG. 12, the channel plate 2 includes circulation channels 43 at a side at which the nozzle plate 1 is disposed. The circulation channel 43 is communicated with the nozzle passage 5, which communicates the nozzle 4 with the individual liquid chamber 6, via the circulation-channel-side fluid restrictor 42. The circulation channel 43 is communicated with the circulation common-liquid chamber 45 of the frame member 20 via the passage 44 extending in a direction perpendicular to a surface of the channel plate 2.

As illustrated in FIG. 11, the frame member 20 includes supply ports 23 communicated with the common liquid chambers 10 and circulation ports (delivery ports) 46 communicated with the circulation common-liquid chambers 45.

Here, the channel plate 2 has a configuration in which five plate members 2D, 2E, 2F, 2B, and 2C are laminated one on another in the recited order from the side at which the nozzle plate 1 is disposed. In the present embodiment, each of the plate member 2B and the plate member 2D is the first plate member, and each of the plate member 2C and the plate member 2E is the second plate member.

As illustrated in (a) of FIG. 13, the plate member 2D has through holes 141. The through hole 141 includes a narrow portion 141*c* being the circulation-channel-side fluid restrictor 42, a broad portion 141*b* being part of the nozzle passage 5 upstream from the circulation-channel-side fluid restrictor 42, and a broad portion 141*a* being part of the circulation channel 43 downstream from the circulation-channel-side fluid restrictor 42 in the liquid flow direction.

As illustrated in (b) of FIG. 13, the plate member 2E has through holes 142 and through holes 143. The through hole 142 constitutes part of the nozzle passage 5 with the broad portion 141*b* of the through hole 141 of the plate member 2D. The through hole 143 constitutes part of the circulation channel 43 with the broad portion 141*a* of the through hole 141 of the plate member 2D.

Similarly with the above-described first embodiment, a partition wall portion 145 between the through hole 142 and the through hole 143 of the plate member 2E is disposed opposite the narrow portion 141*c* of the through hole 141 of the plate member 2D.

In such a case, similarly with the above-described first embodiment, the through hole 142 of the plate member 2E is disposed opposite an outlet portion of the circulation-channel-side fluid restrictor 42 that is an end portion at which the narrow portion 141*c* of the through hole 141 of the plate member 2D is connected to the broad portion 141*a*. The through hole 143 of the plate member 2E is disposed opposite an inlet portion of the circulation-channel-side fluid restrictor 42 that is an end portion at which the narrow portion 141*c* of the through hole 141 of the plate member 2D is connected to the broad portion 141*b*.

In such a configuration, one end of each of the through hole 142 and the through hole 143 of the plate member 2E in the liquid flow direction is disposed opposite a constant-width region of the narrow portion 141*c* of the through hole 141 of the plate member 2D. Accordingly, the partition wall portion 145 is entirely disposed opposite the constant-width region of the narrow portion 141*c*.

With such a configuration, similarly with the above-described first embodiment, the fluid resistance of the circulation-channel-side fluid restrictor 42 can be defined by the length of the partition wall portion 145, thus reducing the variation in the fluid resistance.

Note that, similarly with the above-described second embodiment, an end of one of the through hole 142 and the through hole 143 of the plate member 2E in the liquid flow direction may be disposed opposite the constant-width region of the narrow portion 141*c* of the through hole 141 of the plate member 2D.

The configuration of the fluid restrictor 7 to supply liquid to the individual liquid chamber 6 is similar to the configuration of the fluid restrictor 7 in the above-described first embodiment. However, unlike the plate member 2A of the above-described first embodiment, the plate member 2F has no through holes constituting channels upstream and downstream from the fluid restrictor 7.

Note that, in the above-described embodiments, the channel upstream of the fluid restrictor at the side at which liquid is supplied to the individual liquid chamber is the liquid introduction portion communicated with the common liquid chamber. However, in some embodiments, the channel upstream of the fluid restrictor may be the common liquid chamber. In such a configuration, the fluid restrictor is formed in the channel plate and the common liquid chamber may be forming in another common-liquid-chamber member differing from the common liquid chamber. In other words, a channel having a greater width than the fluid restrictor may be formed at only a downstream side of the fluid restrictor.

Figure 14:
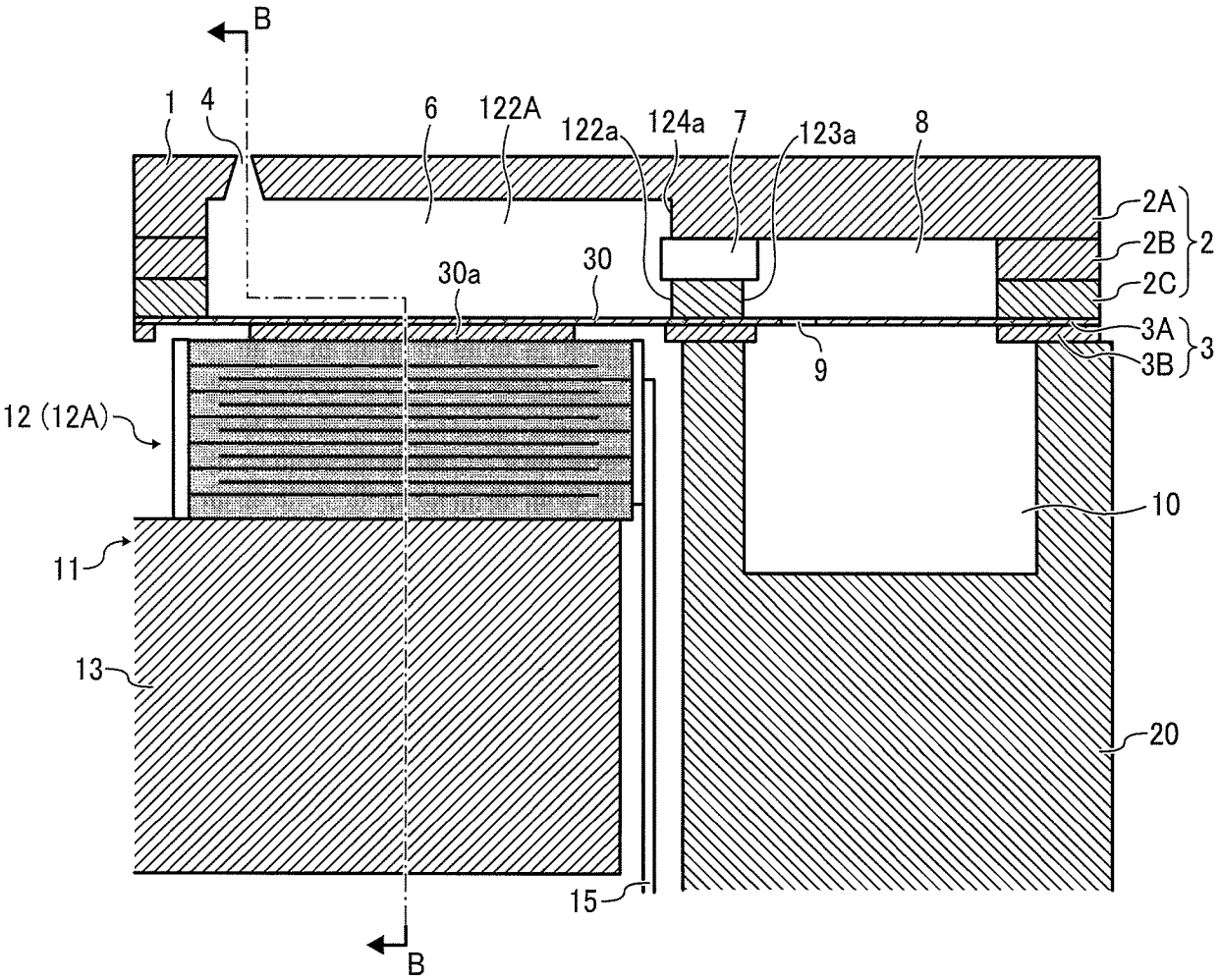
FIG. 14 is a cross-sectional view of the liquid discharge head including grooves according to a fifth embodiment of the present disclosure.

In the above-described embodiments, the examples are described in which the liquid discharge head includes the fluid restrictors and the through holes as channels. However, in some embodiments, for example, in a configuration in which a surface of a plate member in the thickness direction is closed, grooves constituting the fluid restrictors and the channels may be disposed. The above-described embodiments can be modified and applied to the configuration. For example, FIG. 14 is a cross-sectional view of the liquid discharge head including such grooves according to a fifth embodiment of the present disclosure. As illustrated in FIG. 14, in a configuration in which the nozzle plate 1 and the plate member 2A are integrally molded, a groove 122A is formed at a position corresponding to the through hole 124 of the plate member 2A in the first embodiment. The plate member 2C and the diaphragm member 3 may also be integrally molded. In such a configuration, a groove is formed at a position corresponding to the through hole 122 of the plate member 2C in the first embodiment.

Figure 15:
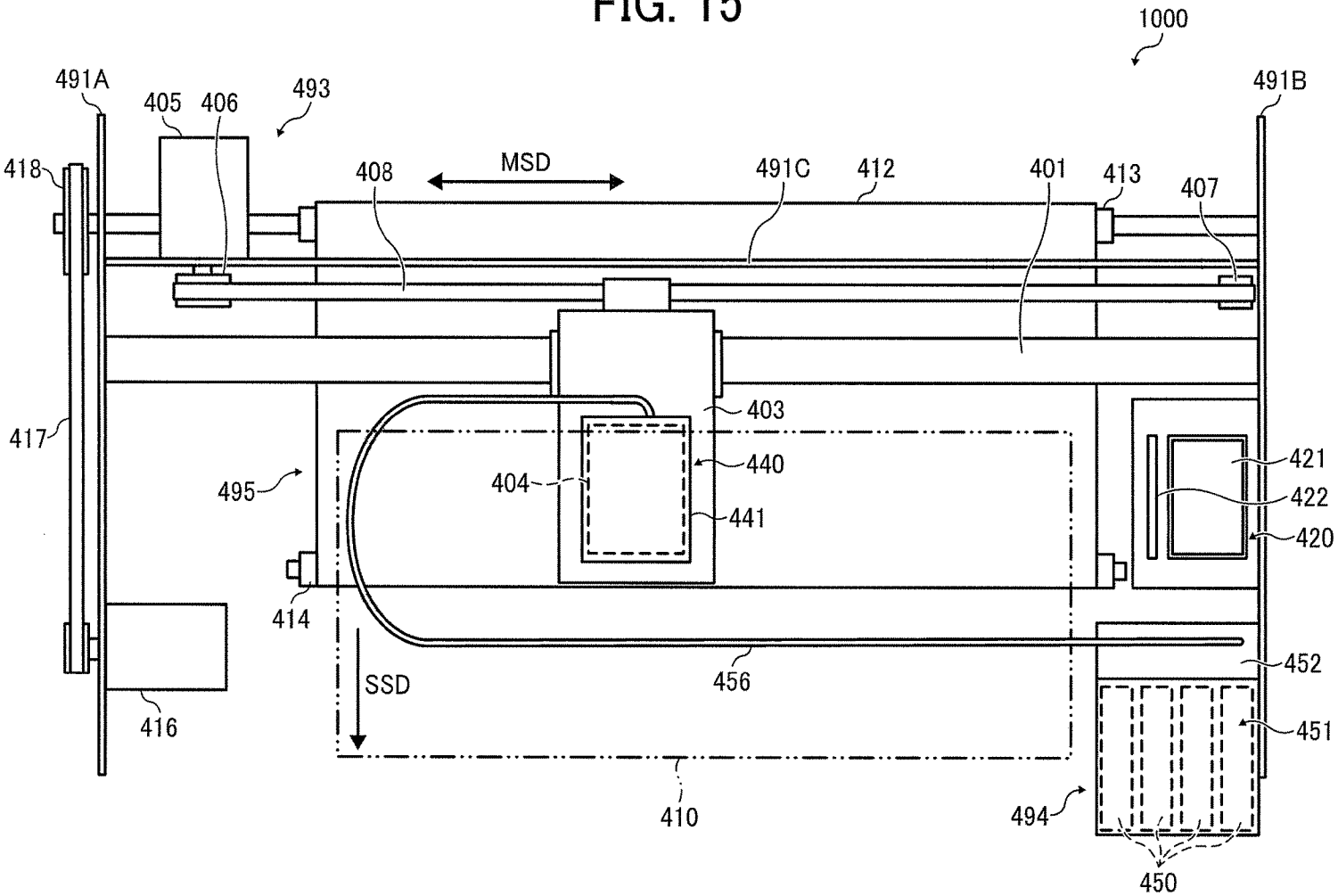
FIG. 15 is a plan view of a portion of a liquid discharge apparatus including a liquid discharge device according to an embodiment of the present disclosure.
Figure 16:
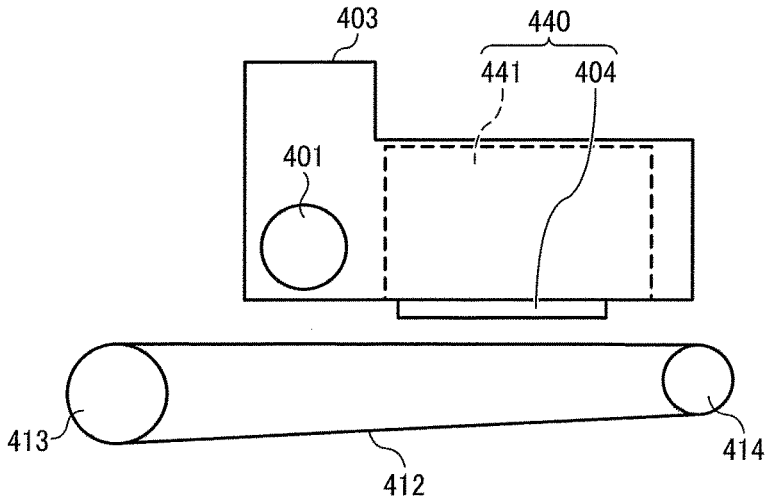
FIG. 16 is a side view of the liquid discharge apparatus of FIG. 15.

Next, a liquid discharge apparatus according to an embodiment of the present disclosure is described with reference to FIGS. 15 and 16. FIG. 15 is a plan view of a portion of the liquid discharge apparatus according to an embodiment of the present disclosure. FIG. 16 is a side view of a portion of the liquid discharge apparatus of FIG. 15.

A liquid discharge apparatus 1000 according to the present embodiment is a serial-type apparatus in which a main scan moving unit 493 reciprocally moves a carriage 403 in a main scanning direction indicated by arrow MSD in FIG. 1. The main scan moving unit 493 includes, e.g., a guide 401, a main scanning motor 405, and a timing belt 408. The guide 401 is laterally bridged between a left side plate 491A and a right side plate 491B and supports the carriage 403 so that the carriage 403 is movable along the guide 401. The main scanning motor 405 reciprocally moves the carriage 403 in the main scanning direction MSD via the timing belt 408 laterally bridged between a drive pulley 406 and a driven pulley 407.

The carriage 403 mounts a liquid discharge device 440 in which the liquid discharge head 404 and a head tank 441 are integrated as a single unit. The liquid discharge head 404 of the liquid discharge device 440 discharges ink droplets of respective colors of yellow (Y), cyan (C), magenta (M), and black (K). The liquid discharge head 404 includes nozzle rows, each including a plurality of nozzles 4 arrayed in row in a sub-scanning direction, which is indicated by arrow SSD in FIG. 1, perpendicular to the main scanning direction MSD. The liquid discharge head 404 is mounted to the carriage 403 so that ink droplets are discharged downward.

The liquid stored outside the liquid discharge head 404 is supplied to the liquid discharge head 404 via a supply unit 494 that supplies the liquid from a liquid cartridge 450 to the head tank 441.

The supply unit 494 includes, e.g., a cartridge holder 451 as a mount part to mount a liquid cartridge 450, a tube 456, and a liquid feed unit 452 including a liquid feed pump. The liquid cartridge 450 is detachably attached to the cartridge holder 451. The liquid is supplied to the head tank 441 by the liquid feed unit 452 via the tube 456 from the liquid cartridge 450.

The liquid discharge apparatus 1000 includes a conveyance unit 495 to convey a sheet 410. The conveyance unit 495 includes a conveyance belt 412 as a conveyor and a sub-scanning motor 416 to drive the conveyance belt 412.

The conveyance belt 412 electrostatically attracts the sheet 410 and conveys the sheet 410 at a position facing the liquid discharge head 404. The conveyance belt 412 is an endless belt and is stretched between a conveyance roller 413 and a tension roller 414. The sheet 410 is attracted to the conveyance belt 412 by electrostatic force or air aspiration.

The conveyance roller 413 is driven and rotated by the sub-scanning motor 416 via a timing belt 417 and a timing pulley 418, so that the conveyance belt 412 circulates in the sub-scanning direction SSD.

At one side in the main scanning direction MSD of the carriage 403, a maintenance unit 420 to maintain and recover the liquid discharge head 404 in good condition is disposed on a lateral side of the conveyance belt 412.

The maintenance unit 420 includes, for example, a cap 421 to cap a nozzle face (i.e., a face on which the nozzles are formed) of the liquid discharge head 404 and a wiper 422 to wipe the nozzle face.

The main scan moving unit 493, the supply unit 494, the maintenance unit 420, and the conveyance unit 495 are mounted to a housing that includes the left side plate 491A, the right side plate 491B, and a rear side plate 491C.

In the liquid discharge apparatus 1000 thus configured, a sheet 410 is conveyed on and attracted to the conveyance belt 412 and is conveyed in the sub-scanning direction SSD by the cyclic rotation of the conveyance belt 412.

The liquid discharge head 404 is driven in response to image signals while the carriage 403 moves in the main scanning direction MSD, to discharge liquid to the sheet 410 stopped, thus forming an image on the sheet 410.

As described above, the liquid discharge apparatus 1000 includes the liquid discharge head 404 according to an embodiment of the present disclosure, thus allowing stable formation of high quality images.

Figure 17:
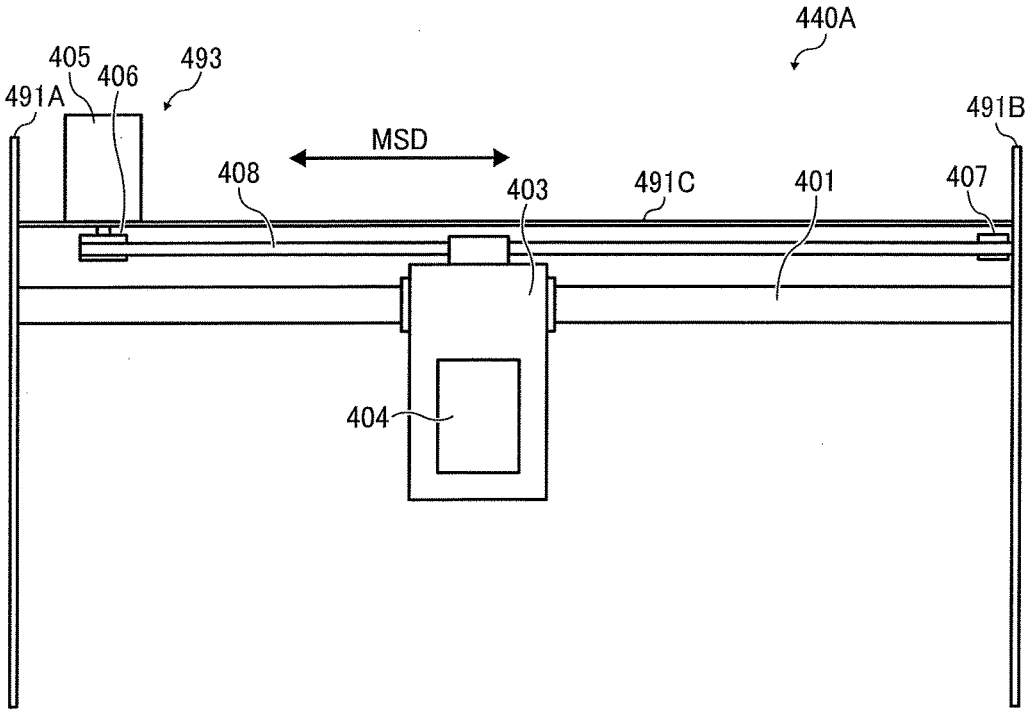
FIG. 17 is a plan view of a portion of the liquid discharge device according to another embodiment of the present disclosure.

Next, another example of the liquid discharge device according to an embodiment of the present disclosure is described with reference to FIG. 17. FIG. 17 is a plan view of a portion of another example of the liquid discharge device (liquid discharge device 440A).

The liquid discharge device 440A includes the housing, the main scan moving unit 493, the carriage 403, and the liquid discharge head 404 among components of the liquid discharge apparatus 1000. The left side plate 491A, the right side plate 491B, and the rear side plate 491C form the housing.

Note that, in the liquid discharge device 440A, at least one of the maintenance unit 420 and the supply unit 494 may be mounted on, for example, the right side plate 491B.

Figure 18:
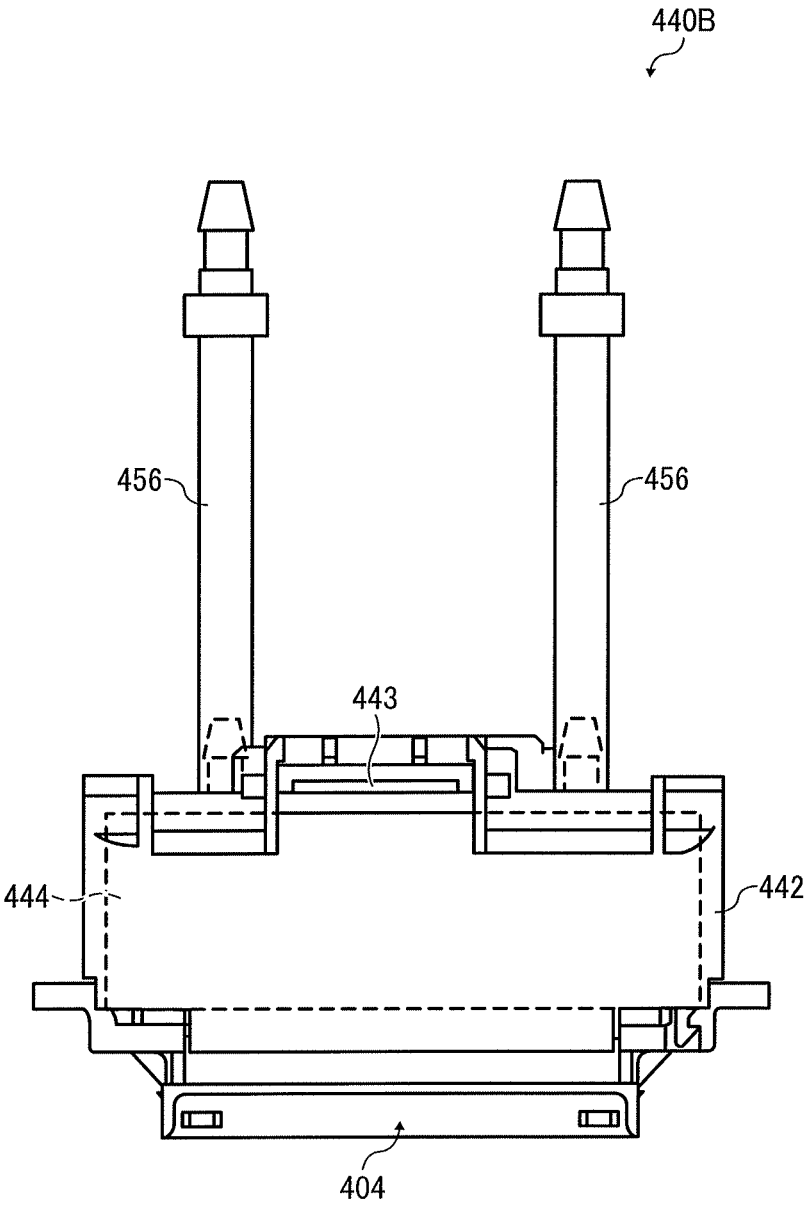
FIG. 18 is a front view of the liquid discharge device according to still another embodiment of the present disclosure.

Next, still another example of the liquid discharge device according to an embodiment of the present disclosure is described with reference to FIG. 18. FIG. 18 is a front view of still another example of the liquid discharge device (liquid discharge device 440B).

The liquid discharge device 440B includes the liquid discharge head 404 to which a channel part 444 is mounted, and the tube 456 connected to the channel part 444.

Further, the channel part 444 is disposed inside a cover 442. Instead of the channel part 444, the liquid discharge device 440B may include the head tank 441. A connector 443 to electrically connect the liquid discharge head 404 to a power source is disposed above the channel part 444.

In the above-described embodiments of the present disclosure, the liquid discharge apparatus includes the liquid discharge head or the liquid discharge device, and drives the liquid discharge head to discharge liquid. The liquid discharge apparatus may be, for example, an apparatus capable of discharging liquid to a material to which liquid can adhere or an apparatus to discharge liquid toward gas or into liquid.

The liquid discharge apparatus may include devices to feed, convey, and eject the material on which liquid can adhere. The liquid discharge apparatus may further include a pretreatment apparatus to coat a treatment liquid onto the material, and a post-treatment apparatus to coat a treatment liquid onto the material, onto which the liquid has been discharged.

The liquid discharge apparatus may be, for example, an image forming apparatus to form an image on a sheet by discharging ink, or a three-dimensional apparatus to discharge a molding liquid to a powder layer in which powder material is formed in layers, so as to form a three-dimensional article.

The liquid discharge apparatus is not limited to an apparatus to discharge liquid to visualize meaningful images, such as letters or figures. For example, the liquid discharge apparatus may be an apparatus to form meaningless images, such as meaningless patterns, or fabricate three-dimensional images.

The above-described term "material on which liquid can be adhered" represents a material on which liquid is at least temporarily adhered, a material on which liquid is adhered and fixed, or a material into which liquid is adhered to permeate. Examples of the "material on which liquid can be adhered" include recording media, such as paper sheet, recording paper, recording sheet of paper, film, and cloth, electronic component, such as electronic substrate and piezoelectric element, and media, such as powder layer, organ model, and testing cell. The "material on which liquid can be adhered" includes any material on which liquid is adhered, unless particularly limited.

Examples of the material on which liquid can be adhered include any materials on which liquid can be adhered even temporarily, such as paper, thread, fiber, fabric, leather, metal, plastic, glass, wood, and ceramic.

Examples of the liquid are, e.g., ink, treatment liquid, DNA sample, resist, pattern material, binder, mold liquid, or solution and dispersion liquid including amino acid, protein, or calcium.

The liquid discharge apparatus may be an apparatus to relatively move a liquid discharge head and a material on which liquid can be adhered. However, the liquid discharge apparatus is not limited to such an apparatus. For example, the liquid discharge apparatus may be a serial head apparatus that moves the liquid discharge head or a line head apparatus that does not move the liquid discharge head.

The liquid discharge apparatus may be, e.g., a treatment liquid coating apparatus to discharge a treatment liquid to a sheet to coat the treatment liquid on the surface of the sheet to reform the sheet surface or an injection granulation apparatus in which a composition liquid including raw materials dispersed in a solution is injected through nozzles to granulate fine particles of the raw materials.

The liquid discharge device is an integrated unit including the liquid discharge head and a functional part(s) or unit(s), and is an assembly of parts relating to liquid discharge. For example, the liquid discharge device may be a combination of the liquid discharge head with at least one of the head tank, the carriage, the supply unit, the maintenance unit, and the main scan moving unit.

Here, the integrated unit may also be a combination in which the liquid discharge head and a functional part(s) are secured to each other through, e.g., fastening, bonding, or engaging, or a combination in which one of the liquid discharge head and a functional part(s) is movably held by another. The liquid discharge head may be detachably attached to the functional part(s) or unit(s) s each other.

The liquid discharge device may be, for example, a liquid discharge device in which the liquid discharge head and the head tank are integrated as a single unit, such as the liquid discharge device 440 illustrated in FIG. 16. The liquid discharge head and the head tank may be connected each other via, e.g., a tube to integrally form the liquid discharge device. Here, a unit including a filter may further be added to a portion between the head tank and the liquid discharge head.

In another example, the liquid discharge device may be an integrated unit in which a liquid discharge head is integrated with a carriage.

In still another example, the liquid discharge device may be the liquid discharge head movably held by a guide that forms part of a main-scanning moving device, so that the liquid discharge head and the main-scanning moving device are integrated as a single unit. Like the liquid discharge device 440A illustrated in FIG. 17, the liquid discharge device may be an integrated unit in which the liquid discharge head, the carriage, and the main scan moving unit are integrally formed as a single unit.

In another example, the cap that forms part of the maintenance unit is secured to the carriage mounting the liquid discharge head so that the liquid discharge head, the carriage, and the maintenance unit are integrated as a single unit to form the liquid discharge device.

Like the liquid discharge device 440B illustrated in FIG. 17, the liquid discharge device may be an integrated unit in which the tube is connected to the liquid discharge head mounting the head tank or the channel part so that the liquid discharge head and the supply unit are integrally formed.

The main-scan moving unit may be a guide only. The supply unit may be a tube(s) only or a loading unit only.

The pressure generator used in the liquid discharge head is not limited to a particular-type of pressure generator. The pressure generator is not limited to the piezoelectric actuator described in the above-described embodiments, and may be, for example, a thermal actuator that employs a thermoelectric conversion element, such as a thermal resistor or an electrostatic actuator including a diaphragm and opposed electrodes.

The terms "image formation", "recording", "printing", "image printing", and "molding" used herein may be used synonymously with each other.

Numerous additional modifications and variations are possible in light of the above teachings. It is therefore to be understood that, within the scope of the above teachings, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

What is claimed is:

1. A liquid discharge head comprising:

a channel plate including:

a fluid restrictor;

a channel disposed on at least one of an upstream side and a downstream side of the fluid restrictor in a direction of flow of liquid, the channel having a greater width than a width of the fluid restrictor in a direction perpendicular to the direction of flow of liquid in an in-plane direction of the channel plate; and a first plate member and a second plate member laminated one on another, the first plate member having a through hole, the through hole including:

at least one broad portion having the greater width and constituting part of the channel; and a narrow portion being the fluid restrictor and having a smaller width than the greater width of the at least one broad portion, the narrow portion connected to the at least one broad portion, the second plate member including at least one through hole that constitutes part of the channel with the at least one broad portion, the at least one through hole disposed opposite an end of the narrow portion of the first plate member at which the narrow portion is connected to the at least one broad portion.

2. The liquid discharge head according to claim 1, wherein the narrow portion includes a constant-width region having a constant width in the direction perpendicular to the direction of flow of liquid in the in-plane direction.

3. The liquid discharge head according to claim 2, wherein the first plate member includes, as the at least one broad portion, two broad portions on an upstream side and a downstream side of the narrow portion in the direction of flow of liquid, wherein the second plate member includes, as the at least one through hole, two through holes communicated with the two broad portions of the first plate member and constituting part of the channel, and wherein a partition wall portion between the two through holes of the second plate member is entirely disposed opposite the constant-width region of the narrow portion of the first plate member in the direction of flow of liquid.

4. The liquid discharge head according to claim 1, wherein the end of the narrow portion has a curved or inclined shape in the in-plane direction.

5. The liquid discharge head according to claim 1, wherein the channel is disposed on each of the upstream side and the downstream side of the fluid restrictor in the direction of flow of liquid, wherein the channel disposed on the downstream side of the fluid restrictor is an individual liquid chamber communicated with a nozzle to discharge liquid, and wherein the channel disposed on the upstream side of the fluid restrictor is one of a common liquid chamber to supply the liquid to the individual liquid chamber and a liquid introduction portion to introduce the liquid from the common liquid chamber.

6. The liquid discharge head according to claim 1, wherein the channel is disposed on each of the upstream side and the downstream side of the fluid restrictor in the direction of flow of liquid, wherein the channel disposed on the downstream side of the fluid restrictor is a nozzle passage communicating a nozzle to discharge the liquid to an individual liquid chamber communicated with the nozzle, and wherein the channel disposed on the upstream side of the fluid restrictor is a circulation channel of the liquid.

7. A liquid discharge device comprising the liquid discharge head according to claim 1, to discharge the liquid.

8. The liquid discharge device according to claim 7,
wherein the liquid discharge head is integrated as a single unit with at least one of:
a head tank to store the liquid to be supplied to the liquid discharge head;
a carriage mounting the liquid discharge head;
a supply unit to supply the liquid to the liquid discharge head;
a maintenance unit to maintain and recover the liquid discharge head; and
a main scan moving unit to move the liquid discharge head in a main scanning direction.

9. A liquid discharge apparatus comprising the liquid discharge device according to claim 7, to discharge the liquid.

10. A liquid discharge apparatus comprising
the liquid discharge head according to claim 1, to discharge the liquid.

11. A liquid discharge head comprising:
a channel plate including:
a fluid restrictor;
a channel disposed on at least one of an upstream side and a downstream side of the fluid restrictor in a direction of flow of liquid, the channel having a greater width than a width of the fluid restrictor in a direction perpendicular to the direction of flow of liquid in an in-plane direction of the channel plate; and
a first plate member and a second plate member laminated one on another,
the first plate member having a groove,
the groove including:
at least one broad portion having the greater width and constituting part of the channel; and
a narrow portion being the fluid restrictor and having a smaller width than the greater width of the at least one broad portion, the narrow portion connected to the at least one broad portion,
the second plate member including at least one groove that constitutes part of the channel with the at least one broad portion,
the at least one groove disposed opposite an end of the narrow portion of the first plate member at which the narrow portion is connected to the at least one broad portion.

12. The liquid discharge head according to claim 11,
wherein the narrow portion includes a constant-width region having a constant width in the direction perpendicular to the direction of flow of liquid in the in-plane direction.

13. The liquid discharge head according to claim 12,
wherein the first plate member includes, as the at least one broad portion, two broad portions on an upstream side and a downstream side of the narrow portion in the direction of flow of liquid,
wherein the second plate member includes, as the at least one groove, two grooves communicated with the two broad portions of the first plate member and constituting part of the channel, and
wherein a partition wall portion between the two grooves of the second plate member is entirely disposed opposite the constant-width region of the narrow portion of the first plate member in the direction of flow of liquid.

14. The liquid discharge head according to claim 11,
wherein the end of the narrow portion has a curved or inclined shape in the in-plane direction.

15. The liquid discharge head according to claim 11,
wherein the channel is disposed on each of the upstream side and the downstream side of the fluid restrictor in the direction of flow of liquid,
wherein the channel disposed on the downstream side of the fluid restrictor is an individual liquid chamber communicated with a nozzle to discharge liquid, and
wherein the channel disposed on the upstream side of the fluid restrictor is one of a common liquid chamber to supply the liquid to the individual liquid chamber and a liquid introduction portion to introduce the liquid from the common liquid chamber.

16. The liquid discharge head according to claim 11,
wherein the channel is disposed on each of the upstream side and the downstream side of the fluid restrictor in the direction of flow of liquid,
wherein the channel disposed on the downstream side of the fluid restrictor is a nozzle passage communicating a nozzle to discharge the liquid to an individual liquid chamber communicated with the nozzle, and
wherein the channel disposed on the upstream side of the fluid restrictor is a circulation channel of the liquid.

17. A liquid discharge device comprising the liquid discharge head according to claim 11, to discharge the liquid.

18. The liquid discharge device according to claim 17,
wherein the liquid discharge head is integrated as a single unit with at least one of:
a head tank to store the liquid to be supplied to the liquid discharge head;
a carriage mounting the liquid discharge head;
a supply unit to supply the liquid to the liquid discharge head;
a maintenance unit to maintain and recover the liquid discharge head; and
a main scan moving unit to move the liquid discharge head in a main scanning direction.

19. A liquid discharge apparatus comprising the liquid discharge device according to claim 17, to discharge the liquid.

20. A liquid discharge apparatus comprising
the liquid discharge head according to claim 11, to discharge the liquid.

* * * * *